US006113523A

United States Patent [19]

Medina

[11] Patent Number: 6,113,523

[45] Date of Patent: Sep. 5, 2000

[54] SIT UP DEVICE

[76] Inventor: David Larry Medina, 655 Taft, San Antonio, Tex. 78225

[21] Appl. No.: 09/007,216

[22] Filed: Jan. 14, 1998

Related U.S. Application Data

[60] Provisional application No. 60/025,505, Sep. 3, 1997.

[51] Int. Cl.[7] ..... A63B 26/00

[52] U.S. Cl. ..... 482/140; 482/131

[58] Field of Search ..... 482/131, 139, 482/140, 904, 908

[56] References Cited

U.S. PATENT DOCUMENTS

| | | | |
|---|---|---|---|
| 4,185,816 | 1/1980 | Bernstein | 482/140 |
| 4,378,939 | 4/1983 | Wild | 482/140 |
| 4,787,626 | 11/1988 | Gallagher | 482/140 |
| 5,186,702 | 2/1993 | Amanze | 482/140 |

*Primary Examiner*—Richard J. Apley
*Assistant Examiner*—Lori Baker
*Attorney, Agent, or Firm*—Cox & Smith Incorporated

[57] ABSTRACT

The invention is of a device which attaches to a standard bed frame in a manner which provides a foot hold for use during sit ups. The device is configured such that it extends outwardly from the side of the bed during use, but the user may swing it around to extend under the bed (and out of sight) when not in use. Applicant's invention permits its practitioner, with optimum convenience and minimal space usage, to engage in a regular, device-assisted exercise regimen.

3 Claims, 3 Drawing Sheets

SIT UP DEVICE

This is a application filed pursuant to 35 USC 199(e) which claims priority based upon the provisional application Ser. No. 60/025,505 filed Sep. 3, 1997.

BACKGROUND OF THE INVENTION

1. Field of the Invention

Applicant's invention relates to exercise devices, and more particularly to devices useful in assisting persons in performing sit ups in a safe and beneficial manner.

2. Background Information

The sit up, if performed properly, is one of the most beneficial physical exercises one can undertake. The obvious benefits of a sit up regimen include toning and desirable contouring of the abdominal muscles, general weight loss, and, to a degree, cardiovascular conditioning.

Less known benefits of a sit up regimen involve the back. It is now known that conditioning of the abdominal muscles has a direct impact on the ability of an individual to maintain a proper spinal column alignment. Hyperkyphosis (excessive curvature of the lower spinal column) is one condition which commonly accompanies poorly conditioned abdominal muscles and excessive weight in the abdominal region. A state of hyperkyphosis places adjacent vertebrae in misalignment, accelerates degradation of the lamina, and ultimately will lead to herniated disks and similar back maladies.

Despite the benefits of sit ups, as previously alluded, sit ups can be performed improperly, in which case excessive strain can be placed on the spinal column with injury far exceeding the potential benefits of the exercise. The present inventor has discovered that pernicious back strain from sit ups can be reduced substantially by performing the sit up while the buttocks is atop a somewhat yieldable surface, such that otherwise excessive leverage forces, sought to be transferred through the pivot point of the sacrum to the back, are dampened a degree by, the yielding of the surface. A typical mattress is an ideal such surface, at least so far as the degree of dampening is concerned.

There are difficulties associated with performing situps on a mattress. The primary difficulty relates to the fact that few beds have features which will serve as functional, much less comfortable, footholds for use during sit ups. Absent footholds, most people are unable to perform sit ups.

Devices are available, ostensibly for aiding in the performance of sit ups, or variations thereof. Such devices are exemplified by a device sold under the brand name ABDOMINZER. A problem with such devices (and common to most bulky, space-consuming exercise equipment) lies with the inconvenience of alternatingly using and storing the device. Because the bedroom is the most common place for using and storing home exercise devices, and most people do not want their exercise equipment to clutter the room between uses, it is quite common for people to skip using their exercise equipment, rather than bother with removing it from storage and later putting it back.

It would be beneficial for persons for whom sit up regimens would be beneficial to have available a device which facilitates the performance of sit ups on a bed and which is unobtrusive between uses, or even during use. Such a device would tend to be more often used, and the users to more likely experience the health benefits of a regular exercise regimen. It would be even further beneficial to provide such a device which is compact and light weight to a degree that one could easily take the device on business or other travel, and use it in hotel rooms, etc.

SUMMARY OF THE INVENTION

It is an object of the present invention to provide a novel exercise device.

It is another object of the present invention to provide a novel exercise device which aids in the performance of sit ups in a safe and beneficial manner.

It is another object of the present invention to provide an exercise device which facilitates the performance of sit ups on a bed.

It is another object of the present invention to provide an exercise device which is unobtrusive between and even during use.

In satisfaction of these and related objectives, the present invention provides a device which attaches to a standard bed frame in a manner which provides a foot hold for use during sit ups. The device is configured such that it extends outwardly from the side of the bed during use, but the user may swing it around to extend under the bed (and out of sight) when not in use. Applicant's invention permits its practitioner, with optimum convenience and minimal space usage, to engage in a regular, device-assisted exercise regimen.

DETAILED DESCRIPTION OF THE PREFERRED EMBODIMENT

Figure 1:
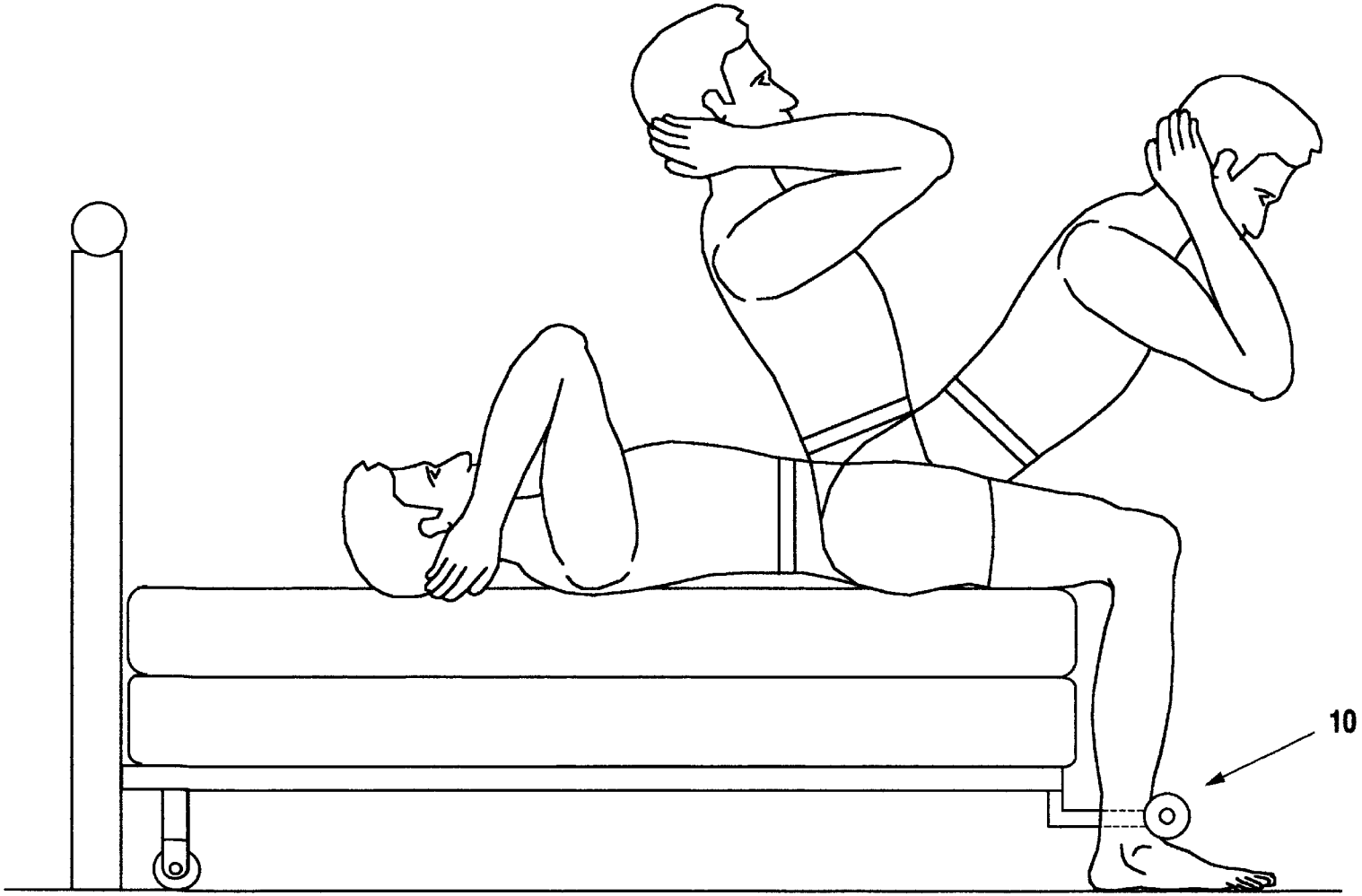
FIG. 1 is an elevational side view of the device of the present invention installed on a conventional bed, with a user of the device positioned on the bed for an intended mode of use of the device.
Figure 2:
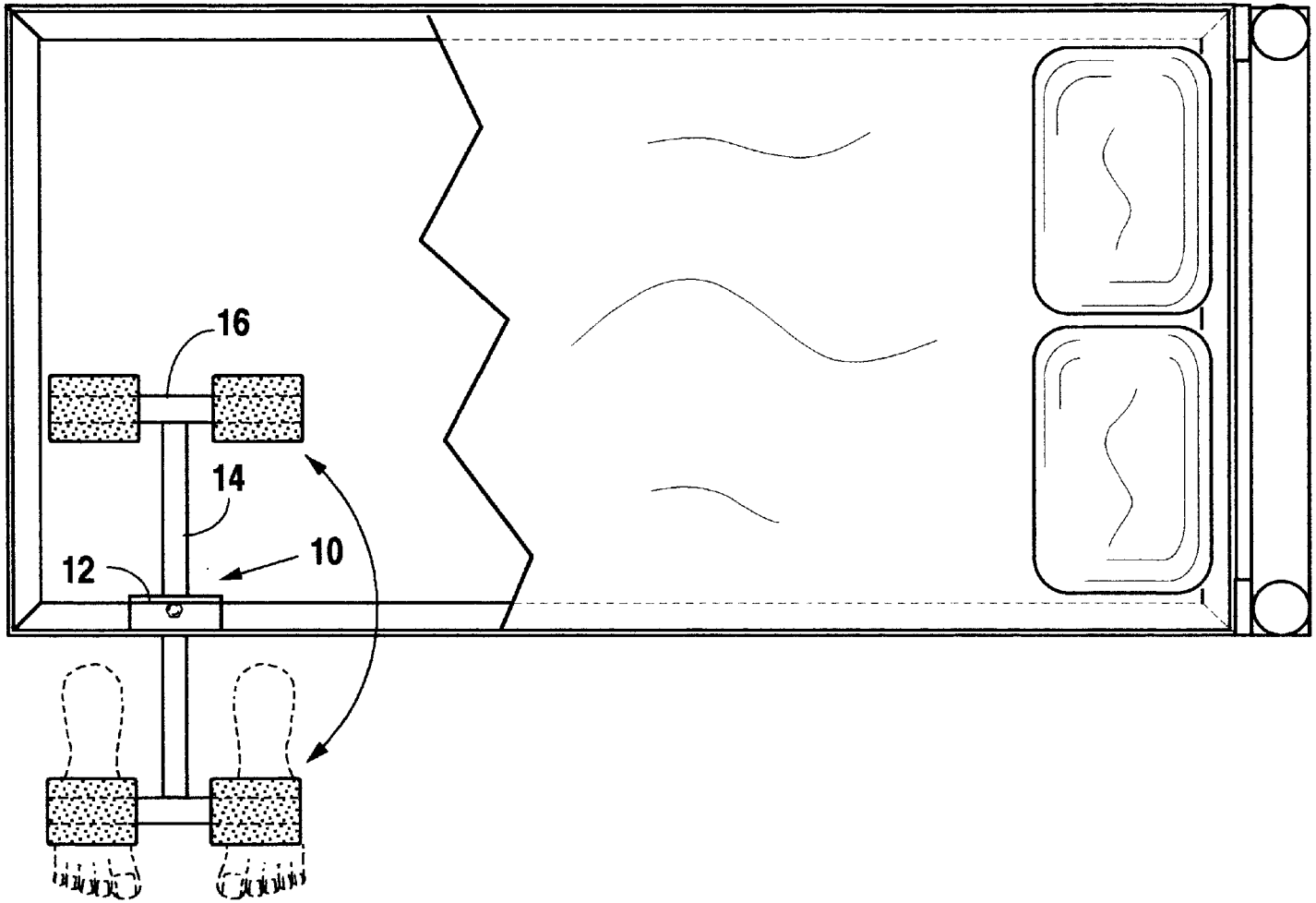
FIG. 2 is a top plan view of a bed with the device of the present invention, shown in a range-of-motion depiction, installed thereon.

Referring to FIG. 1, the sit up assistance device of the present invention is identified generally by the reference numeral 10. Device 10 is depicted in FIG. 1 as attached to the bed frame of a standard bed, with the user of the device positioned on the bed and with the legs and feet configured as they would be during the intended use of device 10. The top plan view of FIG. 2 provides an additional perspective for understanding the intended positioning of device 10. As is apparent, during use, device 10 is rotated to the position where it extends away from the bed, but between uses may be rotated to extend under the bed.

Figure 3:
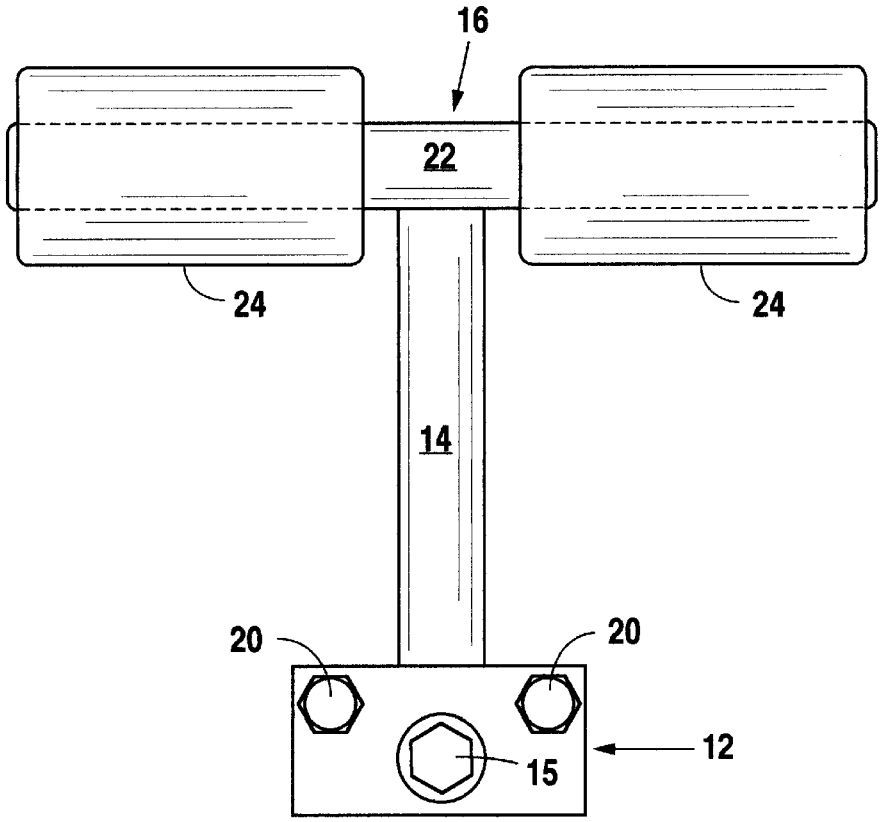
FIG. 3 is a top plan view of the device of the present invention.
Figure 4:
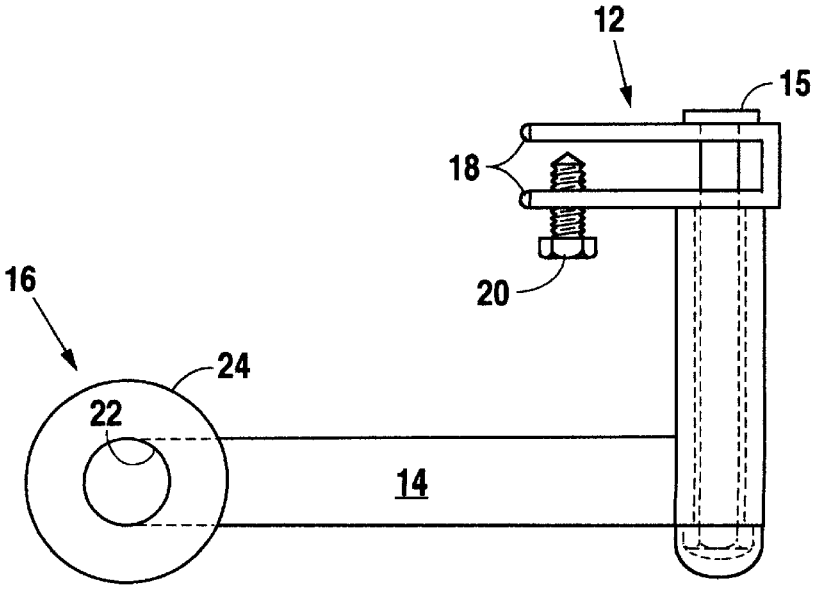
FIG. 4 is a side elevational view of the device of FIG. 3.

Referring to FIGS. 3 and 4, device 10 includes a bed frame mounting bracket 12, an L-shaped extension bar 14, and a foot pad assembly 16. Bed frame mounting bracket 12 is configured for reversible mating with the horizontally disposed, planer segment of the typical angle iron bed rail. Upper and lower tines 18 are to extend on either side of the bed rail (not shown in FIGS. 3 or 4), and are secured in-place by set screws 20.

Extension bar 14 is rotatably attached to bed frame mounting bracket 12 by conventional means, with an axle assembly 15 extending through bed frame mounting bracket 12 and through the adjacent segment of extension bar 14 as shown in FIG. 4. In the preferred embodiment of the present invention, the interface between bed frame mounting bracket 12 and extension bar 14 is configured whereby extension bar 14 rotates smoothly, but not excessively freely.

Foot pad assembly 16 includes a cross bar 22 which is attached to extension bar 14 in a perpendicular orientation, with substantially equal lengths of cross bar 22 extending from either side of its juncture with extension bar 14. Enveloping the lengths of cross bar 22 on either side of such juncture is foam padding 24, such as is commonly found on hand grips, and other body-contact surfaces in exercise equipment.

While device 10 can be manufactured from any number of materials, including tubular metal, the preferred embodiment of the present invention is manufactured from PVC pipe. This affords benefits of economy in manufacturing, and produces a light weight unit which is suitable for carrying on trips away from home.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A sit up assistance device comprising:

a cross bar foot restraint member with which a user of said sit up assistance device interfaces a foot while performing sit ups atop a bed;

an extension bar member having a first extension bar member end and a second extension bar member end, said cross bar foot restraint member being perpendicularly attached to said extension bar member at said first extension bar member end; and a bed frame channel mounting bracket for removably attaching said sit up assistance device to substantially planar member of a bed frame, said bed frame channel mounting bracket being rotatably attached to said extension bar member at said second extension bar member end whereby said extension bar member is rotatable between use and storage configurations.

2. A sit up assistance device as recited in claim 1 wherein substantially equal lengths of said cross bar foot restraint member extend from either side of said first extension bar member end.

3. A sit up assistance device as recited in claim 2 wherein said bed frame channel mounting bracket comprises an upper tine and a lower tine, said upper tine and said lower tine extending on either side of a bed rail for temporary attachment and efficient removal of said sit up assistance device to and from said substantially planar member of said bed frame.

* * * * *